US005351623A

United States Patent [19]

Kissel et al.

[11] Patent Number: 5,351,623

[45] Date of Patent: Oct. 4, 1994

[54] EXPLOSIVE SIMULATOR

[75] Inventors: Robert P. Kissel; Eric P. Johnson, both of LaPlata; Alan L. Gehl, Marbury, all of Md.

[73] Assignee: The United States of America as represented by the Secretary of the Navy, Washington, D.C.

[21] Appl. No.: 79,472

[22] Filed: Jun. 21, 1993

[51] Int. Cl.[5] ..... F42B 8/00

[52] U.S. Cl. ..... 102/498; 102/275.6

[58] Field of Search ..... 102/498, 499, 529, 275.6, 102/275.8, 202.7, 202.8, 444

[56] References Cited

U.S. PATENT DOCUMENTS

| | | | |
|---|---|---|---|
| 3,978,791 | 9/1976 | Lemley et al. | 102/202.14 |
| 4,136,617 | 1/1979 | Fowler | 102/220 |
| 4,445,435 | 5/1984 | Oswald | 102/215 |
| 4,561,848 | 12/1985 | Freeny, Jr. et al. | 437/18 |
| 4,621,577 | 11/1986 | Bickes, Jr. et al. | 102/200 |
| 4,699,063 | 10/1987 | Aschwanden et al. | 102/498 |
| 4,708,060 | 11/1987 | Bickes, Jr. et al. | 102/202.7 |
| 4,843,964 | 7/1989 | Bickes, Jr. et al. | 102/202.5 |
| 4,924,774 | 5/1990 | Lenzen | 102/202.7 |
| 4,976,200 | 12/1990 | Benson et al. | 102/202.7 |
| 4,976,201 | 12/1990 | Hamilton | 102/323 |
| 5,036,588 | 8/1991 | Cherry | 30/180 |
| 5,052,301 | 10/1991 | Walker | 102/202.7 |
| 5,074,218 | 12/1991 | Castro | 102/498 |
| 5,144,893 | 9/1992 | Zeman et al. | 102/202 |

FOREIGN PATENT DOCUMENTS

| | | |
|---|---|---|
| 757383 | 4/1967 | Canada . |
| 2166850 | 5/1986 | United Kingdom . |

OTHER PUBLICATIONS

S. Fordham, High Explosives and Propellants, 125 (1980).

R. Meyer, Explosives, 80–81 (1981).

C. Cherry and R. Kissel, Low Voltage Shock Tube Initiation System (Unpublished).

*Primary Examiner*—David H. Brown

*Attorney, Agent, or Firm*—Tamara L. Weber; W. C. Townsend; Edward J. Connors, Jr.

[57] ABSTRACT

A device is provided which safely simulates the loud noise and bright flash of light of an explosion. This device consists of an ordnance case which encloses a battery, an electronic control module, a charging circuit board, a bridge head, and a shock tube dusted with aluminum and an explosive. The electronic control module provides a time delay between initial activation of the device and the time when the device is ready to create a shock wave. Further, this electronic control module provides a central control for the electronics in the simulator. The charging circuit board uses the battery to charge a capacitor. Passing the voltage stored in the capacitor through the wires of the bridge head causes the explosive and the aluminum in the shock tube to react. This reaction produces a loud noise and bright white flash of light which simulates an explosion.

9 Claims, 5 Drawing Sheets

EXPLOSIVE SIMULATOR

FIELD OF THE INVENTION

This invention provides a explosive simulator which uses a shock tube to produce a loud noise and bright flash of light without producing a risk of personal injury or property damage. This device can be used for law enforcement, riot control, and military training operations.

BACKGROUND OF THE INVENTION

Military personnel must be trained in the proper use and disposal of hand grenades, land mines, claymore antipersonnel mines, and other forms of ordnance. This training is dangerous if actual explosive devices are employed. Thus, there exists a need for explosive simulators which look and sound like actual explosives.

Diversionary devices are designed to create a distraction by reproducing the look and sound of an explosive device while avoiding the risk of personal injury or property damage. An explosive simulator placed within a hand grenade shell provides a diversionary device suitable for law enforcement, riot control, and military training operations. Some diversionary devices operate by reproducing an audio or electronic imitation of an explosion. However, these devices do not provide a realistic sound. Thus, they are not suitable for riot control and hostage rescue operations. Other devices use explosive substances to produce loud noises and bright flashes of light similar to that created by the explosion of a hand grenade. Unfortunately, the diversionary devices produced with these explosive substances can explode with sufficient force to cause serious personal injury. There exists a need for a distraction device which is both realistic and safe.

SUMMARY OF THE INVENTION

This explosive simulator is designed to create a loud noise and bright flash of light without creating a risk of serious injury to the person detonating the device. This device consists of an ordnance case which encloses a battery, an electronic control module, a charging circuit board, a bridge head, and a shock tube. A shock tube is a hollow plastic tube dusted on the inside with an explosive and aluminum. The size of the shock tube and the amount of explosive and aluminum within the shock tube are not critical to the proper functioning of the explosive simulator. Extra explosive will produce a louder noise.

The explosive simulator uses a shock tube dusted with octahydro-1,3,5,7-tetranitro-1,3,5,7-tetrazocine explosives (HMX) and aluminum and designed to be initiated when the HMX is detonated by a high energy shock wave. Such a shock tube is sold under the trademark "NONEL" by the Ensign Bickford Corporation. It is used in the explosive simulator because "NONEL" shock tubes can be easily and inexpensively replaced each time the explosive simulator is detonated.

The electronic control module provides a central control for the electronics in the simulator. The electronic control module also provides a time delay between initial activation of the device and the time when the device is ready to create a shock wave. The time delay feature is desired for training in the handling of explosives since such a delay occurs during the use of actual explosives. It is also possible to construct an explosive simulator without such a time delay feature if such a simulator is desired for use in a diversionary device.

The charging circuit board is controlled by the timing elements in the electronic control module. This charging circuit board uses a battery to charge a capacitor. Passing the voltage stored in the capacitor through the wires of the bridge head causes the explosive and aluminum in the shock tube to react. This reaction produces a bright light. A shock wave travels down the length of the shock tube at a velocity of approximately 6500 feet per second. A loud noise is produced when the shock front emerges from the end of the shock tube.

BRIEF DESCRIPTION OF THE DRAWINGS

The invention will be best understood by referring to the accompanying drawings, wherein.

DETAILED DESCRIPTION

Figure 1:
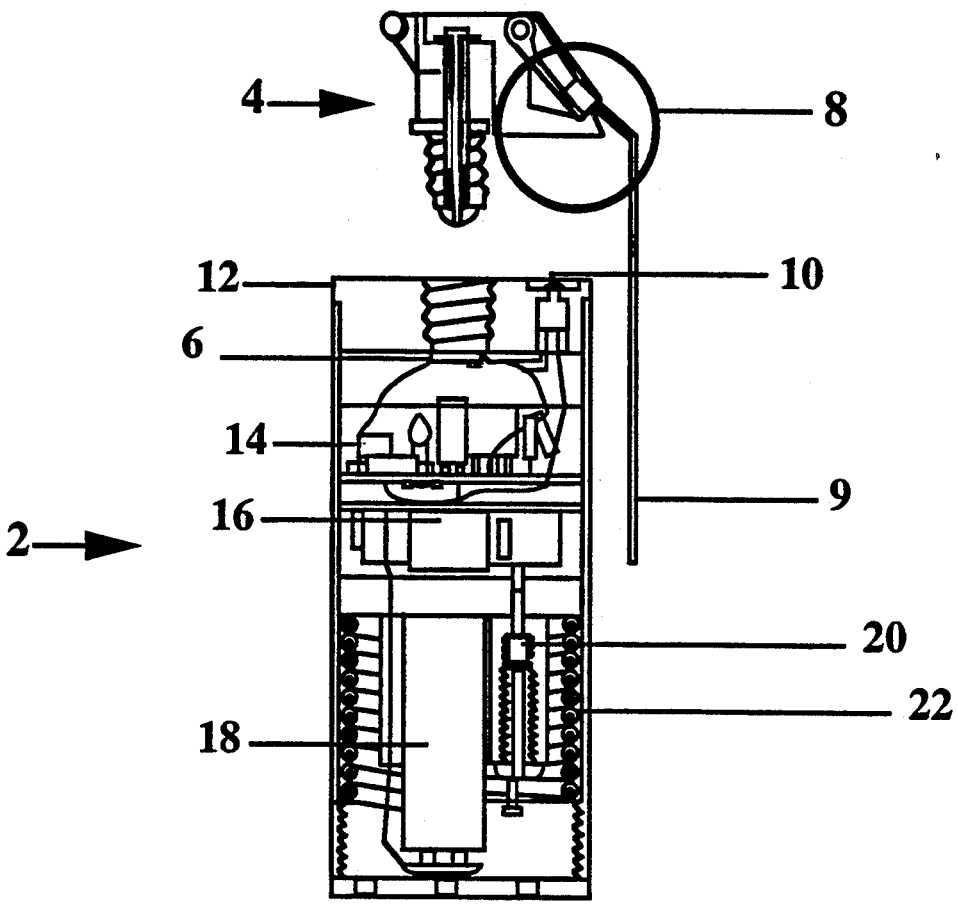
FIG. 1 is a cross sectional view of the explosive simulator in the rest state.
Figure 2:
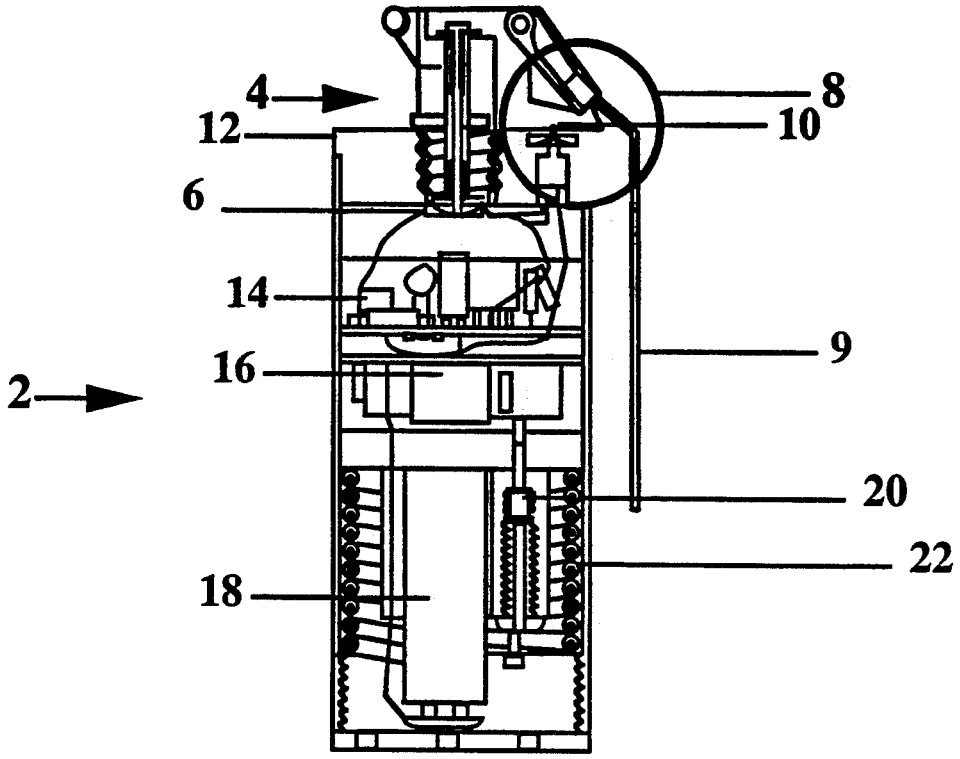
FIG. 2 is a cross sectional view of the explosive simulator in the ready-for-use state.

FIG. 1 and FIG. 2 illustrate an explosive simulator 2 which is suitable for use as a diversionary device. FIG. 1 shows the explosive simulator 2 in the rest state. The fuse head 4 is a sub-assembly of the explosive simulator 2. In FIG. 2, the explosive simulator 2 is ready for use since the fuse head 4 is in contact with the electrical contact for the fuse switch 6. The fuse head 4 is connected to a ring 8 and handle 9.

A pre-charge and battery test switch 10 is located at the top of the case 12. This case 12 is composed of a thermoplastic carbonate-linked polymer such as "LEXAN". This case 12 encloses an electronic control module 14, a charging circuit board 16, a 9 volt battery 18, a bridge head 20, and a "NONEL" shock tube 22. The electronic control module 14 provides a central control for the electronics in the explosive simulator 2 and provides a time delay between initial activation of the explosive simulator 2 and the time when the "NONEL" shock tube 22 is detonated. The charging circuit board 16 is controlled by the timing elements in the electronic control module 14.

The electronic control module 14 is set for the desired delay between initial activation of the explosive simulator 2 and the time when the "NONEL" shock tube 22 is detonated. After this desired delay period has expired, the electronic control module 14 sends a pulse to the charging circuit board 16. This pulse activates an electronic switch and sends power to the bridge head 20. This bridge head 20 consists of two small solid copper wires embedded in a carbon-based phenolic. This phenolic is a non-conductive, castable resin material. The explosive simulator 2 passes approximately 330 volts into the copper wires. When this high voltage is passed into these wires it causes some of the carbon near the end of the two copper wires to vaporize.

The bridge head 20 is located within the "NONEL" shock tube 22. The electrical spark that is emitted from the end of the bridge head 20 is sufficient to initiate a reaction of the HMX and aluminum dust. This reaction of the HMX and aluminum dust propagates the shock down the length of the "NONEL" shock tube 22 at a velocity of 6500 feet per second. The "NONEL" shock tube 22 does not rupture. The reaction of the HMX and aluminum in the "NONEL" shock tube 22 produces a flash of light seen through the wall of the "NONEL" shock tube 22. A loud noise is produced when the shock front emerges from the end of the "NONEL" shock tube 22. This device can be reused upon replacement of the "NONEL" shock tube 22.

Figure 3:
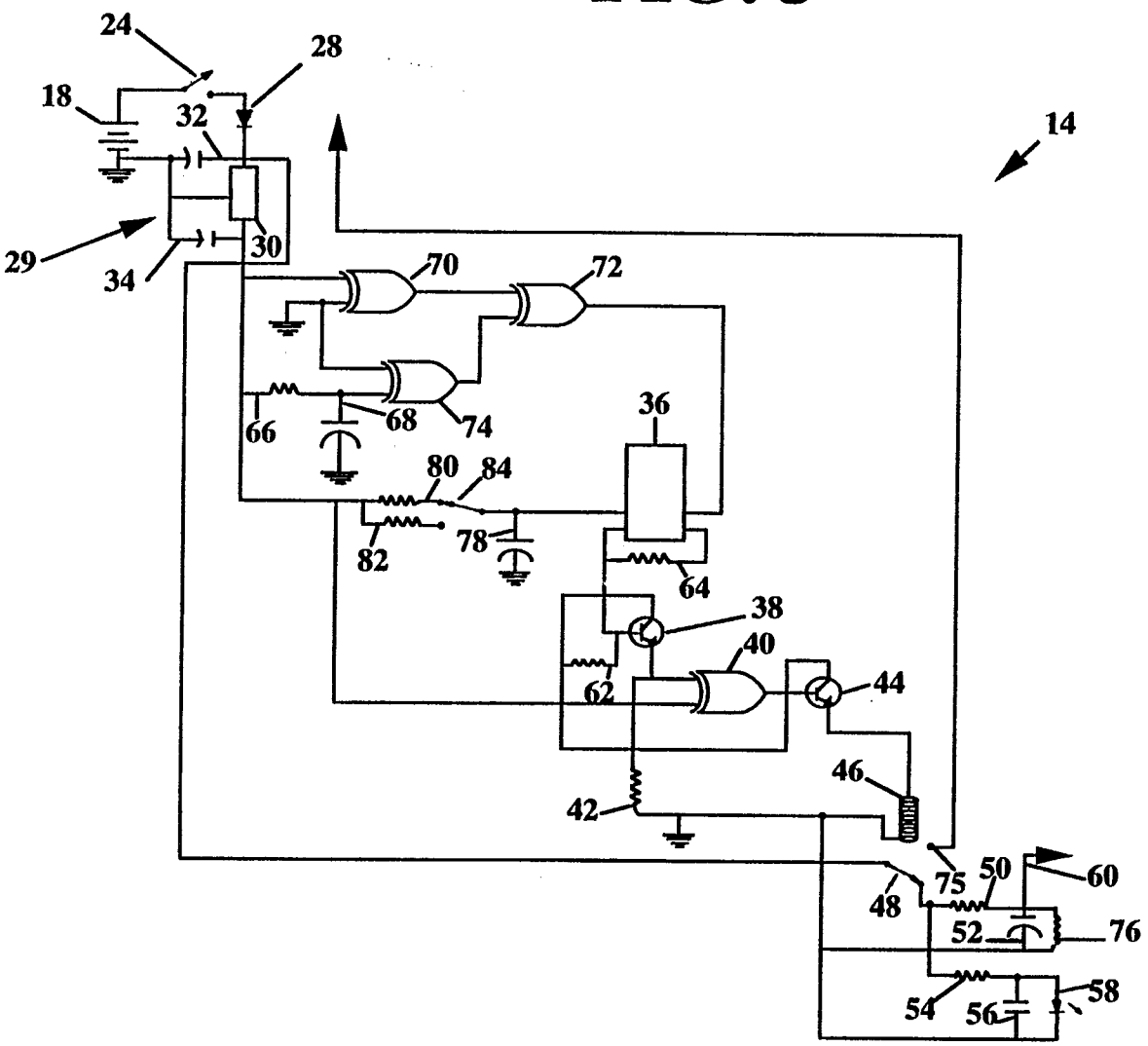
FIG. 3 is a schematic diagram illustrating the electronic control module.

FIG. 3 illustrates the electronic control module 14. When the electronic control module 14 is in a rest state, a switch 24 is in the open position. No components are energized.

The electronic control module 14 is placed in an active standby state when a switch 24 is moved to the closed position, allowing energy from the battery 18 to pass through a diode 28 to the voltage regulation circuit 29. The voltage regulation circuit 29 includes an integrated circuit 30 and two capacitors 32, 34. Power is passed to power all chip components. Integrated circuit 36 sets up in standby, passing voltage to transistor 38, biasing it to send a signal to OR gate 40 which is connected to resistor 42. OR gate 40 inverts this signal and passes no signal to transistor 44, thereby not activating inductor 46. While in this state, power passes through switch 48 into resistor 50, capacitor 52, resistor 54, and capacitor 56. If minimal time is spent in this state, photoemissive diode 58 will not illuminate. Resistor 62 is used to bias transistor 38, while resistor 64 is used to feedback the status of the output of integrated circuit 36. Resistor 66 and capacitor 68, in conjunction with OR gate 70, OR gate 72, and OR gate 74, generate an activation pulse which takes integrated circuit 36 out of the standby state into the full active state.

When the electronic control module 14 begins the full active state, integrated circuit 36 drops its output to the "low" state, thereby turning off transistor 38, which changes the output of OR gate 40 to full "on", energizing transistor 44, and activating inductor 46. Inductor 46 pulls switch 48 into contact with the upper contact 75. Both capacitor 52 and capacitor 56 slowly discharge through resistor 76. Integrated circuit 36 continues in this full active state until completion of a predetermined wait cycle. The predetermined wait cycle is controlled externally by the capacitor 78 and either resistor 80 or resistor 82. The setting of the switch 84 determines which of either resistor 80 or resistor 82 is used. Upon completion of the wait cycle, the output of integrated circuit 36 goes to the "high" state. This energy is passed back to inhibit cycling through resistor 64. Energy is passed to transistor 38, engaging the transistor 38 to the "on" state, and changing the output of OR gate 40 to "low", inhibiting power to inductor 46. This loss of power in the inductor 46 allows the switch 48 to fall to the rest state. Power then passes to recharge capacitor 52 and capacitor 56. Photoemissive diode 58 illuminates when capacitor 56 is fully charged. After the electronic control module 14 has completed its required activation sequencing, it will remain in the full active state until the switch 24 is opened. Opening the 14 switch 24 causes capacitor 32, capacitor 34, capacitor 52, capacitor 56, capacitor 68, and capacitor 78 to discharge the stored electric charge.

Figure 4:
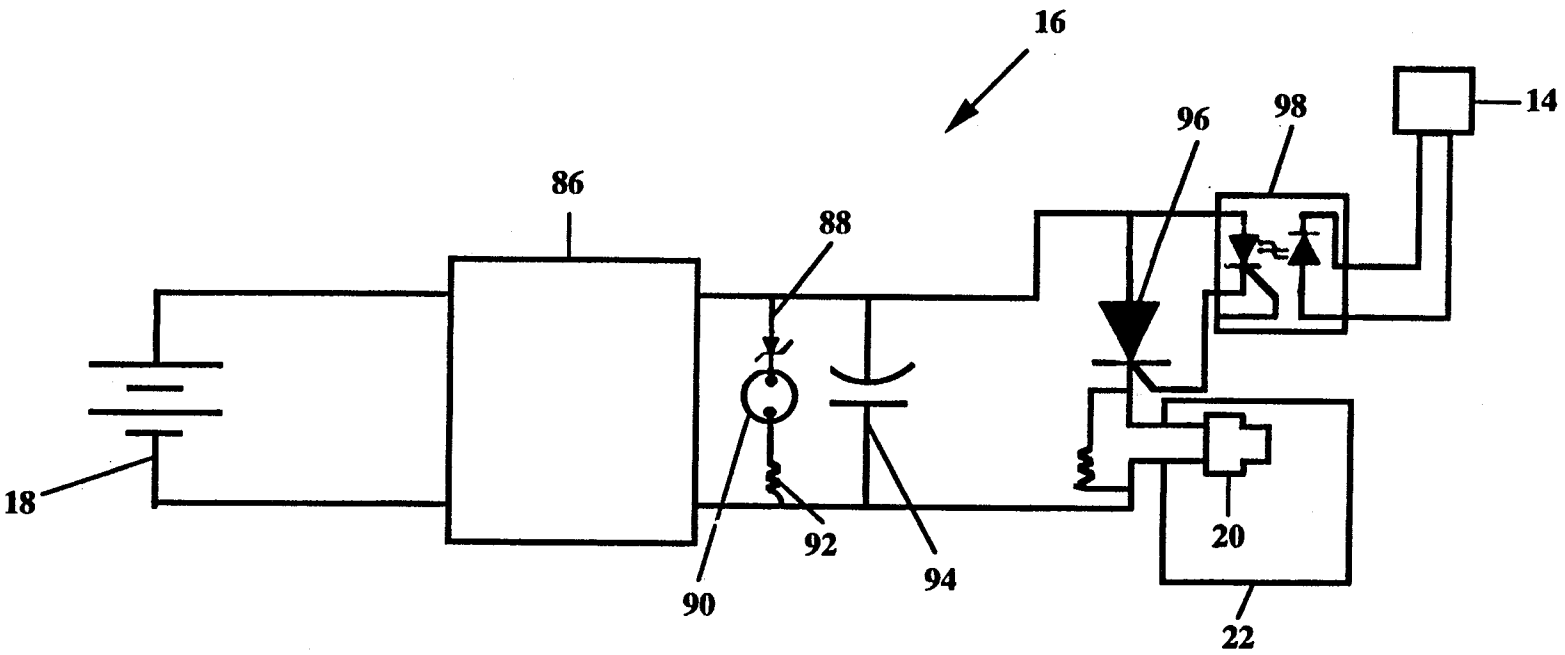
FIG. 4 is a schematic diagram illustrating the charging circuit board connected to the battery and the bridge head.

FIG. 4 illustrates the charging circuit board 16 connected to the battery 18 and the bridge head 20. The charging circuit board 16 uses a high voltage converter 86 to step up the voltage from the battery 18 to 330 volts. The zener diode 88, the neon light 90, and the resistor 92 are used to regulate the output voltage to 330 volts. The storage capacitor 94 is used to store the energy that is used to detonate the "NONEL" shock tube 22. The silicon-controlled rectifier 96 is used to fire the energy stored in the storage capacitor 94 through the bridge head 20. The silicon-controlled rectifier 96 is triggered using an optoisolator 98 which receives a signal from the electronic control module 14.

Figure 5:
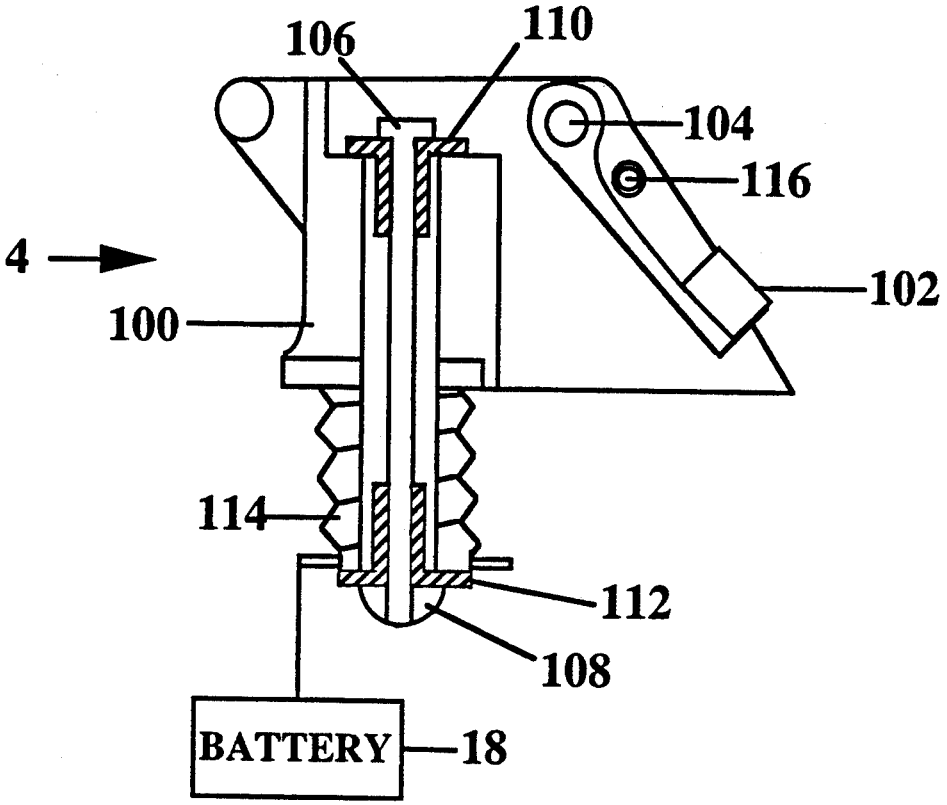
FIG. 5 is a cross sectional view of the fuse head.

FIG. 5 illustrates the fuse head 4. The fuse body 100, striker 102, and striker pin and spring 104 are made from aluminum, and are used as the negative electrical contact. The center contact 106 and nut 108 are insulated from the fuse body 100 by the top insulator 110 and the bottom insulator 112. A wire from the negative terminal of the battery 18 is in electrical contact with the thread 114. The wire to the electronic circuits is in electrical contact with the nut 108 on the bottom of the center contact 106. When the striker retaining pin 116 is removed, the striker 102 pivots around striker pin and spring 104 and strikes the center contact 106. This completes the electrical circuit from the battery 18 to the electronic circuits. Alternatively, the fuse head 4 could be replaced by a toggle switch.

When the explosive simulator 2 is to be used, the operator depresses the pre-charge and battery test switch 10. Pressing the pre-charge and battery test switch 10 charges the storage capacitor 94 to its operating voltage of 330 volts. The operator of the explosive simulator 2 should note the amount of time which elapses from the time he presses the pre-charge and battery test switch 10 until the neon light 90 on the charging circuit board 16 illuminates. If the neon light 90 takes too long to illuminate, the battery 18 is too low for proper operation and must be replaced. Once the storage capacitor 94 has been charged it will stay charged for up to 8 hours, and the explosive simulator 2 can be used at any time within these 8 hours. After 8 hours, the storage capacitor 94 must be recharged by depressing the pre-charge and battery test switch 10.

Alternatively, the explosive simulator 2 can operate in the training mode by pulling the ring 8 and striker retaining pin 116 out of the explosive simulator 2. Then, the handle 9 is free to move as soon as the device is thrown. When the handle 9 is released, the striker 102 throws the handle 9 clear of the explosive simulator 2. The striker 102 contacts the center contact 106, and thus completes the electrical circuit. This electrical contact activates the electronic control module 14 and starts the pre-set delay count. The electronic control module 14 applies power to the charging circuit board 16, so the charging circuit board 16 can charge the storage capacitor 94 as the pre-set delay is running.

After the pre-set delay on the electronic control module 14 has expired, the electronic control module 14 sends a pulse to the charging circuit board 16. This pulse activates the optoisolator 98, which triggers the silicon-controlled rectifier 96. The silicon-controlled rectifier 96 is used to fire the energy stored in the storage capacitor 94 through the bridge head 20. The bridge head 20 consists of two small solid copper wires embedded in a carbon-based phenolic. High voltage passed into these wires causes some of the carbon near the ends of the two copper wires to vaporize. This creates an electrical spark.

The electrical spark caused by the high voltage passed into the copper wires of the bridge head 20 creates a shock pressure sufficient to initiate the "NO- NEL" shock tube 22. This shock wave propagates down the length of the "NONEL" shock tube 22 at a velocity of 6500 feet per second. The "NONEL" shock tube 22 does not rupture. The HMX and aluminum in the "NONEL" shock tube 22 react to produce a bright white flash of light. A loud "bang" is heard as the shock front emerges from the end of the "NONEL" shock tube 22. The bright flash and loud noise are not harmful, but are bright enough and loud enough to simulate an explosion.

This invention has been described in detail with particular reference to certain preferred embodiments thereof, but it should be understood that variations and modifications can be effected within the spirit and scope of the invention. It is particularly noted that many different types of shock tubes are manufactured for the commercial blasting industry. Any of these shock tubes could replace the "NONEL" shock tube. It is further noted that the explosive simulator can be placed in a case with the shape of a land mine, claymore antipersonnel mine, or any other form of ordnance.

What is claimed is:

1. An explosive simulator for use with a battery comprising:
   - a shock tube dusted with aluminum and an explosive material,
   - a bridge head,
   - means for transmitting power from a battery to said bridge head,
   - means for delaying transmission of power to said bridge head, and
   - a case,
   - wherein, said case encloses said shock tube, said bridge head, said means for transmitting power from a battery to said bridge head, and said means for delaying transmission of power to said bridge head,
   - wherein, said delayed transmission of power to said bridge head causes a delayed explosion in said bridge head,
   - whereby, said explosion in said bridge head detonates said aluminum and said explosive material in said shock tube,
   - whereby, a loud noise and bright flash of light are produced.

2. The explosive simulator of claim 1 wherein said means for transmitting power from a battery to said bridge head comprises:
   - a capacitor,
   - whereby, said capacitor stores said power from said battery, and
   - a silicon-controlled rectifier,
   - whereby, said silicon-controlled rectifier fires the power stored in said capacitor through said bridge head.

3. The explosive simulator of claim 2 further comprising a pre-charge and battery test switch located on said case,
   - wherein, pressing said pre-charge and battery test switch charges said capacitor to the operating voltage of said capacitor.

4. The explosive simulator of claim 3 wherein said case is composed of a thermoplastic carbonate-linked polymer.

5. The explosive simulator of claim 4 wherein said explosive material comprises HMX.

6. The explosive simulator of claim 5 further comprising:
   - a fuse body,
   - a striker attached to said fuse body,
   - a striker retaining pin,
   - a striker pin and spring attached to said fuse body,
   - wherein said fuse body is connected by a wire to said battery,
   - a fuse center contact,
   - wherein, said fuse center contact is connected by a wire to said means for delaying transmission of power to said bridge head, and
   - means for insulating said fuse body from said fuse center contact,
   - whereby, removal of said striker retaining pin allows said striker to pivot around said striker pin and spring and strike said fuse center contact,
   - whereby, the electrical circuit from the battery to the means for delaying transmission of power to said bridge head is completed.

7. The explosive simulator of claim 6 wherein said case is composed of a thermoplastic carbonate-linked polymer.

8. The explosive simulator of claim 7 wherein said explosive material comprises HMX.

9. A method of simulating an explosion comprising the steps of:
   - dusting the inside of a shock tube with aluminum and HMX,
   - forming a bridge head from copper wires and a carbon-based phenolic,
   - placing said bridge head within said shock tube, and
   - providing power to said bridge head,
   - whereby, some of the carbon near the end of said copper wires vaporizes,
   - whereby, said vaporization of said carbon causes a reaction of said aluminum and said HMX in said shock tube,
   - whereby, the reaction of said aluminum and said HMX produces a bright white flash of light and propagates a shock wave in said shock tube,
   - whereby, a loud noise is produced when said shock front emerges from the end of said shock tube,
   - whereby, said bright white flash of light and said loud noise simulate an explosion.

* * * * *